US006068053A

United States Patent [19]

Shaw

[11] Patent Number: 6,068,053

[45] Date of Patent: May 30, 2000

[54] FLUID SEPARATION AND REINJECTION SYSTEMS

[75] Inventor: Christopher K. Shaw, Claremore, Okla.

[73] Assignee: Baker Hughes, Ltd., Middlesex, United Kingdom

[21] Appl. No.: 08/966,096

[22] Filed: Nov. 7, 1997

Related U.S. Application Data

[60] Provisional application No. 60/030,003, Nov. 7, 1996.

[51] Int. Cl.[7] ..... E21B 37/00

[52] U.S. Cl. ..... 166/267; 210/512

[58] Field of Search ..... 166/267, 75.12, 166/261, 259, 265, 68.5; 210/512.2, 512.1, 787, 788; 175/324

[56] References Cited

U.S. PATENT DOCUMENTS

| | | | |
|---|---|---|---|
| 2,953,204 | 9/1960 | Doscher et al. . | |
| 3,137,344 | 6/1964 | Weimer . | |
| 3,593,789 | 7/1971 | Prats | 166/259 |
| 3,593,790 | 7/1971 | Herce | 166/267 |
| 3,596,993 | 8/1971 | Busey | 299/5 |
| 3,705,626 | 12/1972 | Glenn, Jr. et al. . | |
| 3,951,457 | 4/1976 | Redford . | |
| 3,978,926 | 9/1976 | Allen . | |
| 4,033,412 | 7/1977 | Barrett | 166/267 |
| 4,120,795 | 10/1978 | Lavel, Jr. . | |
| 4,148,735 | 4/1979 | Lavel, Jr. . | |
| 4,241,787 | 12/1980 | Price . | |
| 4,296,810 | 10/1981 | Price . | |
| 4,354,553 | 10/1982 | Hensley . | |
| 4,475,603 | 10/1984 | Hayatdavoudi . | |
| 4,488,607 | 12/1984 | Hayatdavoudi et al. . | |
| 4,688,650 | 8/1987 | Hayatdavoudi et al. . | |
| 4,721,565 | 1/1988 | Carroll . | |
| 4,738,779 | 4/1988 | Carroll et al. . | |
| 4,766,957 | 8/1988 | McIntyre . | |
| 4,787,452 | 11/1988 | Jennings, Jr. . | |
| 4,793,408 | 12/1988 | Miffre . | |
| 4,805,697 | 2/1989 | Fouillout et al. . | |
| 4,824,562 | 4/1989 | Carson . | |
| 4,836,935 | 6/1989 | Lilienthal . | |

(List continued on next page.)

FOREIGN PATENT DOCUMENTS

| | | |
|---|---|---|
| 0 532 397 A1 | 3/1993 | European Pat. Off. . |
| 2194575 | 3/1988 | United Kingdom . |
| WO 94/13930 | 6/1994 | WIPO . |
| WO 96/30625 | 10/1996 | WIPO . |

OTHER PUBLICATIONS

Pete Schrenkel, Robert Cox, Steve Kennedy and Bill Bowers; "Joint Industry Development of the Downhole Oil Water Separation System".

B.E. Bowers, D.D. Lloyd, C. Matthews and P. Schrenkel; "Downhole Application of Liquid–Liquid Hydrocyclones".

B.R. Peachey and C.M. Matthews, "Downhole Oil/Water Separator Development"; *The Journal of Canadian Petroleum Technology*; vol. 33, No. 7 (Sep. 1994).

B.R. Peachey and C.M. Matthews, "Downhole Oil/Water Separator Development"; Petroleum Society of CIM, Paper No. CIM 93 (circa 1994).

(List continued on next page.)

*Primary Examiner*—Eileen Dunn Lillis
*Assistant Examiner*—Chong S. Cho
*Attorney, Agent, or Firm*—Thomason, Moser & Patterson, L.L.P.

[57] ABSTRACT

The present invention provides an apparatus and method of producing a stream of hydrocarbons and water from a wellbore and separating the stream into a hydrocarbon-rich stream and a water-rich stream that can be reinjected into the wellbore from which it was produced. The method involves producing a production stream from production tubing in the wellbore to a separator located at least partially above the wellbore, separating the production stream into a water-rich stream and an oil-rich stream, reinjecting the water-rich stream into the wellbore from which it was produced; and maintaining separation of the water-rich stream from the production stream.

21 Claims, 5 Drawing Sheets

U.S. PATENT DOCUMENTS

| | | | |
|---|---|---|---|
| 4,900,433 | 2/1990 | Dean et al. . | |
| 5,095,983 | 3/1992 | Magnani | 166/250 |
| 5,296,153 | 3/1994 | Peachey . | |
| 5,320,500 | 6/1994 | Cholet . | |
| 5,335,732 | 8/1994 | McIntyre . | |
| 5,456,837 | 10/1995 | Peachey . | |
| 5,497,832 | 3/1996 | Stuebinger et al. . | |
| 5,503,226 | 4/1996 | Wadleigh . | |
| 5,570,744 | 11/1996 | Weingarten et al. . | |
| 5,603,825 | 2/1997 | Costinel . | |
| 5,693,225 | 12/1997 | Lee | 210/512.2 |
| 5,730,871 | 3/1998 | Kennedy et al. | 210/512.2 |

OTHER PUBLICATIONS

"Downhole Oil/Water Separation Technology Now Proven", Centre for Engineering Research Inc., Press Release (Apr. 1, 1995).

T. Kjos, READ Group A.S, J.F. Michelet, READ Process Engineering A.S., S. Sangesland, "Subsea and DownHole Separation System—The Latest Advances", Pater, *Norwegian Institute of Technology*, Paper No. XP 000671682. (Undated).

FLUID SEPARATION AND REINJECTION SYSTEMS

This application claims the benefit of U.S. Provisional Application No. 60/030,003, filed Nov. 7, 1996.

BACKGROUND OF THE INVENTION

1. Field of the Invention

The present invention relates to apparatus and methods used for separation of a mixed fluid such as a production fluid obtained in underground wells which is comprised of a mixture of oil and water. In one specific aspect, the invention provides for separation of the mixed fluid at a location outside of the wellbore. Water which is separated from the mixed production fluid is then transmitted to a second downhole location for reinjection into the producing formation.

2. Description of Related Art

Increasingly, fluid separation systems are being incorporated into oil production facilities. hydrocyclone-based separators are known which are capable of substantially separating a mix of two liquids having different densities into two streams of those constituent liquids. Gravity separators are also known in which an oil/water mixture within a separator pot is separated through natural gravitational forces so that the oil floats to the top of the pot and removed and the water is removed toward the lower end of the pot. Some composite or staged systems are known in which an initial separation of the mixed production fluid is accomplished by a gravity separator. Water separated from the production fluid by the gravity separator then has additional oil removed from it by parallel hydrocyclones.

Borehole separator arrangements are known for separation of production fluids. With these, a hydrocyclone-based separator is incorporated into the production tubing string and placed downhole. Locating the separator assembly itself within the wellbore in this manner permits the water to be removed while it is still downhole rather than producing excess water along with the oil produced. Further, the water separated by a separator which is located within the wellbore could potentially be reinjected into other portions of that wellbore such as into injection perforations. One disadvantage to this type of separation and reinjection arrangement is that the sizes of the separator assembly as well as the flow tubing into and out of the separator assembly is restricted by those which are capable of fitting within the wellbore casing diameter.

A few arrangements have been used wherein a separator assembly is located at the surface of the wellbore outside of the opening of the well so that the wellbore diameter does not restrict the size of the separator assembly and the associated flow tubing. These surface-based separator assemblies include a gravity separator placed in series with parallel hydrocyclone separators. Production fluid is pumped to the surface of the well and from there into the separator assembly where an initial separation of the production fluid into separated oil and separated water is performed by the gravity separator. Following the initial separation, the stream of separated water is transmitted through the two hydrocyclones for removal of residual oil. The residual oil removed by the hydrocyclones is then added to the separated oil for collection. Surface based systems such as this typically draw production fluid from each of several wells within a field of wells and direct all of the production into a single manifold. One large separator unit is integrated downstream of the manifold as part of the production flowline. Such a system is described in a recent publication entitled "Subsea Water Separation" by Velle et al. However, control of this single separator and hydrocyclone assembly is complex and, in most cases, requires electrical signaling to properly open and close valves to regulate the system. Specifically, a control valve is associated with the oil/water pot of the gravity separator which regulates the level of the oil/water interface within the pot. Regulator valves are required to bring the hydrocyclones on and off line in order to maintain their flow rates within the operating band.

Unfortunately, operation of the single separator system is also dependent upon its receipt of an adequate amount of composite flow from the multiple wells. The relationship between the flow rate and operation of the hydrocyclone and separator assembly is commonly measured by the turndown ratio for the separator assembly. The turndown ratio is the ratio of the separator assembly's maximum capacity to its minimum capacity required for operation. When production is obtained from multiple wells rather than a single well, the possibility of falling below the minimum required capacity is increased. If production from some of the multiple wells were to cease or be significantly reduced, flow rate into the single separator assembly might become inadequate to ensure proper separation.

A related problem exists with surface-based central separator arrangements used in subsea systems where the separator assembly is located on the sea bed. Upon separation of the production fluid, separated oil is transported to the surface via a production line while separated "clean" water is released into the sea. Unfortunately, release of produced clean water into the sea can create problems for and impose additional costs upon petroleum producers. Current regulations require that released fluid contain less than 40 parts per million (ppm) of oil. The well operator or supervisor is obligated to monitor the levels of oil in the released fluid and make reports of its content. Oil level monitors must be installed to measure the amount of oil present in the discharge. Typically, redundant monitors are required to insure accuracy and to guard against failure of a single monitor.

Additionally, it is noted that the use of oil/water separation equipment has traditionally been associated with late stage production from wells. Therefore, these assemblies have been emplaced in prior art wells after production through traditional production strings has become uneconomical. However, the initial production string must first be pulled from the well in order to install the separation assemblies, particularly those separation assemblies which must be located within the wellbore.

The methods and apparatus of the present invention overcome the drawbacks inherent in the prior art.

SUMMARY OF THE INVENTION

The methods and apparatus of the present invention are directed generally toward separator and reinjection systems wherein the separator assembly is located at the surface outside of the well opening where it is more accessible than downhole separator assemblies for repair or replacement. Where multiple producing wells are involved, each well has a separate separator assembly associated with it. A reinjection string is associated with the producing well and separator assembly so that separated clean water is directed back into the wellbore so that it might be injected into injection perforations. Arrangements are described for reinjection of separated water uphole of the production perforations as well as downhole of the production perforations. The invention also contemplates that separated water might be directed for reinjection into a wellbore other than the one from which production is obtained, such as an injection well.

In another aspect of the present invention, methods are described for incorporating a separator and reinjection assembly into the initial production assembly early in the life of the well. A bypass flow path is associated with the separator and reinjection assembly. Production flow may be selectively through either the bypass flow path or the separator assembly. This permits separation to be avoided during the initial rich production of the well, but accomplished during the later lean production stages.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
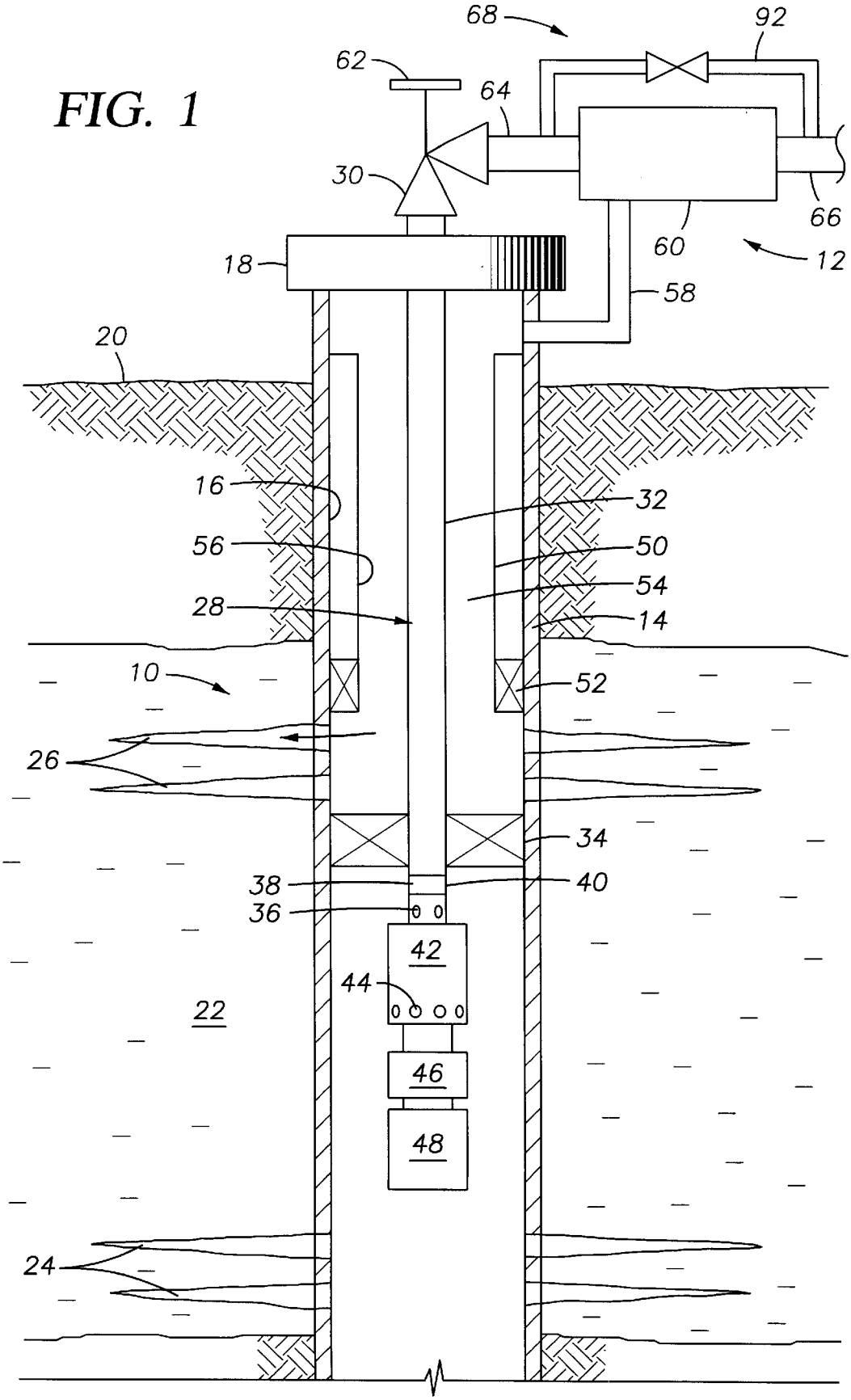
FIG. 1 is a cross-sectional depiction of an exemplary fluid separation system constructed in accordance with the present invention having a surface-based separator assembly and means for injection of separated water back into the wellbore.

In the following description, common features among the described embodiments will be designated by like reference numerals. Unless otherwise specifically described in the specification, components described are assembled or affixed using conventional connection techniques including threaded connection, collars and such which are well known to those of skill in the art. The use of elastomeric O-rings and other standard techniques to create closure against fluid transmission is also not described herein in any detail as such conventional techniques are well known in the art and those of skill in the art will readily recognize that they may be used where appropriate. Similarly, the construction and operation of hanger systems and wellheads is not described in detail as such are generally known in the art. Examples of patents which describe such arrangements are U.S. Pat. No. 3,918,747 issued to Putch entitled "Well Suspension System," U.S. Pat. No. 4,139,059 issued to Carmichael entitled "Well Casing Hanger Assembly," and U.S. Pat. No. 3,662,822 issued to Wakefield, Jr. entitled "Method for Producing a Benthonic Well." These patents are incorporated herein by reference.

Because the invention has application to wells which may be deviated or even horizontal, terms used in the description such as "up," "above," "upward" and so forth are intended to refer to positions located closer to the wellbore opening as measured along the wellbore. Conversely, terms such as "down," "below," "downward," and such are intended to refer to positions further away from the wellbore opening as measured along the wellbore.

Referring first to FIG. 1, a first exemplary hydrocarbon production well 10 is shown schematically which incorporates a separation and reinjection arrangement, indicated generally at 12 which will be described in further detail shortly. The well 10 includes a wellbore casing 14 which defines an annulus 16 and extends downward from a wellbore opening or entrance 18 at the surface 20. It is noted that the surface 20 may be either the surface of the earth, or, in the case of a subsea well, the seabed. The well casing 14 extends through a hydrocarbon production zone 22 from which it is desired to acquire production fluid. The well casing 14 has production perforations 24 disposed therethrough so that production fluid may enter the annulus 16 from the production zone 22. Injection perforations 26 are also disposed through the casing 14 which permit fluid communication therethrough from the annulus 16 into the production zone 22. In this instance, the well 10 is an "uphole" arrangement in that the injection perforations 26 are located "uphole" from the production perforations 24.

A production string assembly 28 is disposed downward within the annulus 16 supported from a wellhead 30 at the surface 20. The production string assembly 28 includes production tubing 32 which is affixed at its upper end to the wellhead 30. A production tubing packer 34 is set below the injection perforations 26 to establish a fluid seal between the production tubing 32 and the casing 14. The production tubing 32 includes lateral fluid inlets 36 below the packer 34 which permits fluid communication from the annulus 16 into the interior of the production tubing 32. A slidable sleeve 38, of a type generally known in the art, is incorporated into the production tubing 32. One suitable sleeve for this application is the Model CM™ Series Non-Elastomeric Sliding Sleeve available from Baker Oil Tools of Houston, Tex. The slidable sleeve 38 is selectively moveable between a first position wherein the lateral ports 36 are open to permit fluid communication and a second position wherein the lateral ports are closed to such fluid communication. Although the slidable sleeve 38 may be actuated to move between its two positions by any technique known in the art, it is preferably actuated by means of an actuating motor 40 which is energized and operated by a wireless electronic signal transmitted from a remote location such as the surface. One such currently available system for providing such wireless signals is known as the "EDGE" system, also commercially available from Baker Oil Tools.

A fluid pump 42 is affixed to the lower end of the production tubing 32 which is operably interconnected to pump fluids upward through the production tubing 32. The pump 42 may be a multistage centrifugal pump or a progressive cavity pump or other pump suitable for pumping of downhole production fluids. The fluid pump 42 includes a number of lateral fluid intake ports 44 disposed about its circumference so that production fluid within the annulus 16 may be drawn into the pump 42 when the pump 42 is operated.

At the lower end of the pump 42 is affixed an elastomer seal 46 and motor 48 which, when energized, will operate the fluid pump 42 to pump fluids. Each of these components is well known in the art. The motor 48 is preferably an electrical submersible motor of a type known in the art to operate downhole pumps. Although not shown in the drawings, downhole motors such as motor 48 normally are provided power via power cables which extend from the surface to the motor. An actuation switch is typically located in the vicinity of the wellhead for the well, and, when the well is subsea, the actuation switches are controlled by signals sent to the switches along a cable from a remote source, such as a ship or other platform. It is highly preferred that the motor 48 is located between the production perforations 24 and the fluid intake ports 44 of the fluid pump 42 so that production fluid exiting the production perforations 24 will flow past the motor 48 to cool it during operation.

The upper portion of the production tubing 32 may optionally be radially surrounded by a fluid separation liner or sleeve 50 which extends from the well opening 18 downward to a point within the annulus 16 proximate the injection perforations 26. A packer 52 is set at the lower end of the sleeve 50 to establish a fluid seal between the outer surface of the sleeve 50 and the casing 14. A restricted fluid flow passage 54 is defined between the outer surface of the production tubing 32 and the inner bore 56 of the sleeve 50. It is noted that the purpose of providing the sleeve 50 is to provide an additional barrier between the produced brine and any fresh water aquifers and such a sleeve is typically required for onshore production arrangements. The sleeve 50 may not be required if the annulus 16 itself can be pressurized. At the upper end of the sleeve 50, a lateral fluid flowline 58 extends from the flow passage 54 within sleeve 50 to a separator assembly 60 which is located outside of the wellbore opening 18.

The wellhead 30 features an adjustable choke 62 of a type known in the art which is used to control the flow of production fluids through the wellhead 30. A lateral fluid flowline 64 extends from the wellhead 30 into the separator assembly 60. Additionally, a fluid collection flowpipe 66 extends from the separator assembly 60 to a collection device (not shown).

Figure 2:
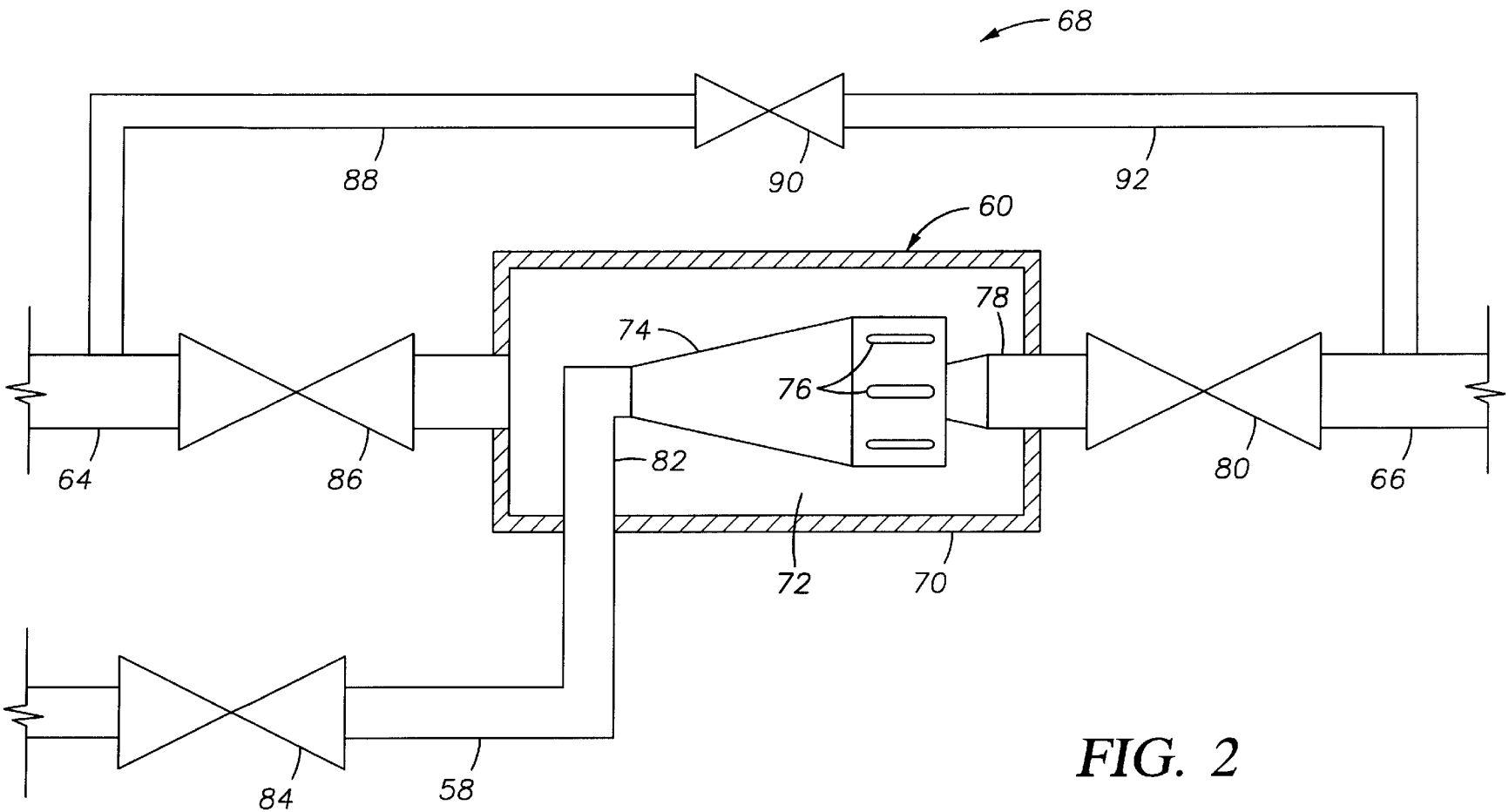
FIG. 2 is a schematic detail of a portion of the system of FIG. 1 showing an exemplary mechanism for selectively directing the flow of production fluid through either a bypass flow path or the separator assembly.

A bypass assembly, designated generally at 68 in FIG. 1, is interconnected to the flowline 64 and the collection flowpipe 66. Further details regarding the bypass assembly 68 and its association with other components are described with respect to FIG. 2. FIG. 2 shows one embodiment of the hydrocyclone-based separator assembly 60. It should be noted that numerous other constructions are possible which might include multiple hydrocyclones. The separator assembly 60 includes an outer housing 70 which encloses a fluid chamber 72. A hydrocyclone 74 is disposed within the chamber 72. The hydrocyclone 74 features lateral fluid inlet ports 76 at its enlarged end. Overflow tubing 78 extends from the enlarged end of the hydrocyclone 74 through the housing 70 and connects to a control valve 80 which can be opened or closed to selectively close fluid flow from the overflow tubing 78 into the collection flow pipe 66. Underflow tubing 82 extends from the narrow end of the hydrocyclone 74 and is disposed through the housing 70 and connects to flow line 58. The flow line 58 also includes a control valve 84 to selectively close flow of fluid through the flow line 58. Flow line 64 also extends through the housing 70 and includes a control valve 86 which controls fluid flow through the flow line 64 into the fluid chamber 72 of the separator assembly 60.

A first bypass piping segment 88 extends laterally from flow line 64 and is interconnected via a control valve 90 to a second bypass piping segment 92 which, in turn, adjoins collection piping 66.

A preferred operation of the exemplary well 10 involves the use of different production techniques as appropriate for different stages of well production. Because production zone characteristics and conditions differ between wells, all of these stages may not be present in all wells and, therefore, operation of the well using each of the described techniques may not be appropriate. However, three stages for exemplary well production are described herein to facilitate understanding of the various modes of operation.

In the first described stage of production, a relatively rich production fluid is obtained. This fluid is described as rich in that it contains a great amount of oil relative to water. For example, presently a production fluid containing less than 70% water is considered to be rich. However, the determination as to what constitutes a rich production fluid is left to the particular oil producer. It is typically not desired to cause this rich production fluid to be passed through a separator assembly to separate the oil from the water within. Further, in the first production stage, the rich production fluid enters the annulus 16 under sufficient natural pressure from the production zone 22 so that pumping of the production fluid toward the surface is not necessary.

In the second described exemplary stage of production, the production fluid being obtained is still rich in that it is not necessary to cause it to be separated into constituent oil and water components. In the second stage of production, however, the formation pressure within the production zone 22 has decreased to the point where it is desired to pump the production fluid to assist it out of the well 10. The point at which it is desired to begin pumping is, again, to be determined by the desires of the particular oil producer. The decision to begin pumping may be made based upon the production reaching either a predetermined fluid pressure, a predetermined flow rate for reinjected water or a predetermined water content.

Techniques for measuring or monitoring parameters such as these are known in the art. Fluid pressure, for example, may be measured using pressure transducers emplaced within the wellbore. One system which incorporates transducers and is useful for accomplishing this function is the Baker Sentry pressure transmitter system available commercially from Baker Oil Tools. Fluid pressure might also be determined at the wellhead by measuring flowing tubing head pressure. Fluid flow rate may be measured using any of a variety of flowmeters known in the art, such as a turbine flowmeter or positive displacement flowmeter. Water content in the production fluid may be determined by measuring the oil/water ratio of production fluid samples or by measuring conductance or by measuring the density of the production fluid using a device such as a gamma ray densitometer.

In the third described exemplary stage of production, the production fluid obtained has become less rich in that a greater amount of water is contained within the production fluid. In the third stage, it is desired to separate the production fluid into the oil and water components.

According to methods of the present invention, after the well 10 has been drilled and perforated, using well known techniques not described here, the components of the production string assembly 28 are installed in the well along with those of the separation and reinjection system 12. The bypass assembly 68 is also installed initially. Additionally, the slidable sleeve 38 should be positioned in its first position to permit fluid communication through the lateral ports 36. Control valves 86 and 80 are closed and control valve 90 is opened to cause produced fluid to pass through the bypass assembly 68. The choke 62 is then opened to allow initial production from through the wellhead 30, rich production fluid is obtained from production perforations 24 in the following manner. Production fluid from the production zone 22 enters the annulus 16 via the production perforations 24 and then enters the production tubing 32 through the lateral fluid ports 36. The production fluid is then transmitted upward through production tubing 32 through wellhead 30, fluid flow line 64, bypass assembly 68, and, finally, collection pipe 66.

As production enters the second stage and formation pressure drops within the production zone 22, the motor 40 is energized to actuate the slidable sleeve 38 and cause it to move to its second position wherein the lateral fluid ports 36 are closed to fluid communication. The motor 48 is then energized to operate the pump 42. The pump 42 then draws production fluid within the annulus 16 through ports 44 and then upward through the production tubing 32, wellhead 30, fluid flow line 64, bypass assembly 68, and, finally, collection pipe 66.

As production enters the third stage, the production fluid has become much less rich and, at this point, it is desired to direct the production fluid through the separator assembly 60. Valves 86 and 80 are both opened and valve 90 is closed to cause production fluid to flow through the separator assembly 60 rather than the bypass assembly 68. Production fluid pumped through the production tubing 32 and wellhead 30 enters the lateral flow line 64 and passes through the control valve 86 to enter the fluid chamber 72 of the separator assembly 60. Because the production fluid is under pressure within the chamber 72, it enters the inlets 72 of the hydrocyclone 74 to be separated into a separated oil stream and a separated water stream. The separated oil stream exits the hydrocyclone 74 through the overflow tubing 78, the control valve 80 and the collection pipe 66. The separated water stream exits the hydrocyclone 74 through the underflow tubing 82 and is disposed through flow line 58 and flow passage 54 so that the water can be directed toward the injection perforations 26. A control valve 84 is interconnected within the flow line 58 and is used to selectively restrict flow through the flow line 58 in order to maintain a pressure balance in the flow line 58.

Figure 3:
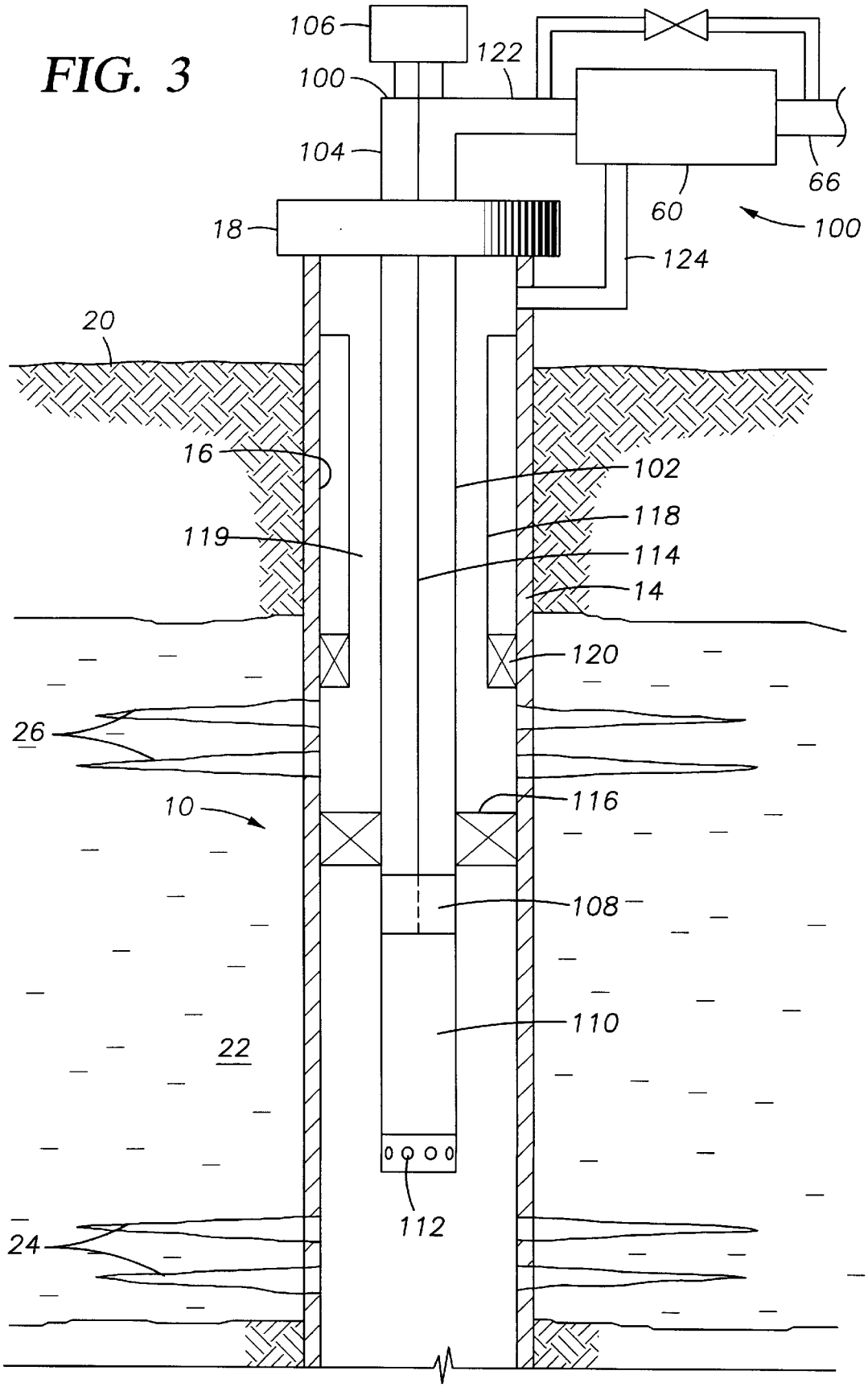
FIG. 3 is a cross-sectional schematic depiction of a second exemplary separation system in accordance with the present invention having a surface-based separator assembly with means for injection of separated water back into the well.

Referring now to FIG. 3, a second exemplary embodiment of a separator and reinjection assembly is shown which is constructed in accordance with the present invention. Exemplary well 10 is shown schematically which incorporates a separation and reinjection arrangement, indicated generally at 100. As described previously, the well 10 includes a casing 14 which defines an annulus 16 and extends downward from an opening 18 at the surface 20. The well casing 14 extends through a hydrocarbon production zone 22 and has production perforations 24 and injection perforations 26 disposed therethrough to permit fluid communication between the annulus 16 and the production zone 22. The injection perforations 26 are located uphole from the production perforations 24 in a typical "uphole" arrangement.

Production tubing 102 extends downward within the annulus 16 from the surface 18. The upper end of the production tubing 102 is sealed by a conventional wellhead 104 upon which is mounted a motor 106. The production tubing 102 is affixed at it lower end to an elastomer seal 108 and fluid pump 110. The pump 110 presents lateral fluid inlets 112 through which fluids may be drawn into the pump 110. A drive shaft 114 extends downwardly from the motor 106 to the seal 108 and pump 110 so that operation of the motor 106 will cause the pump 110 to pump. In this regard, the motor 106 may be a rotary-type motor which causes the drive shaft 114 to rotate. The pump would be a progressive cavity pump (PCP) of a type known in the art. Alternatively, the motor 106 could be a reciprocating motor which would move the drive shaft 114 alternately upward and downward in a reciprocating manner to operate the pump 110. In that case, the pump 110 would be a piston-type pump adapted to be operated by a reciprocated shaft. A production packer 116 is set at the lower end of production tubing 102 below the injection perforations 26 to establish a fluid seal between the outer surface of the tubing 102 and the casing 14 of the well 10.

A sleeve or liner 118 radially surrounds the upper portion of the production tubing 102 and a packer 120 is set proximate the lower end of the sleeve 118 to establish a fluid seal between the outer surface of the sleeve 118 and the inner surface of the casing 14. A restricted flow passage 119 is defined between the inner radial surface of the sleeve 118 and the outer surface of the production tubing 102. A flow line 122 extends from the upper end of the production tubing 102 toward the separator assembly 60. Also, a flow line 124 extends from the flow passage 119 toward the separator assembly 60.

Production from well 10 occurs as follows during the third stage of production when it is desired to both pump production fluid and to cause the production fluid to undergo separation. Motor 106 is energized to operate pump 110 and cause production fluid from production perforations 24 to enter ports 112 of the pump 110. The pump 110 pumps the production fluid through production tubing 102, flow line 122 and into the separator assembly 60 for separation into constituent streams of separated oil and separated water. The separated oil is then directed through collection pipe 66 while the separated water is directed through flow line 124 and restricted flow passage 119 toward the injection perforations 26.

It is noted that operation of the separation and reinjection system 100 depicted in FIG. 3 is identical to that described for the separation and reinjection system 12 discussed with respect to FIG. 1. Also, operation of the exemplary well 10 may be altered in a manner similar to that described in connection with FIG. 1 to accommodate various stages in production.

Figure 4:
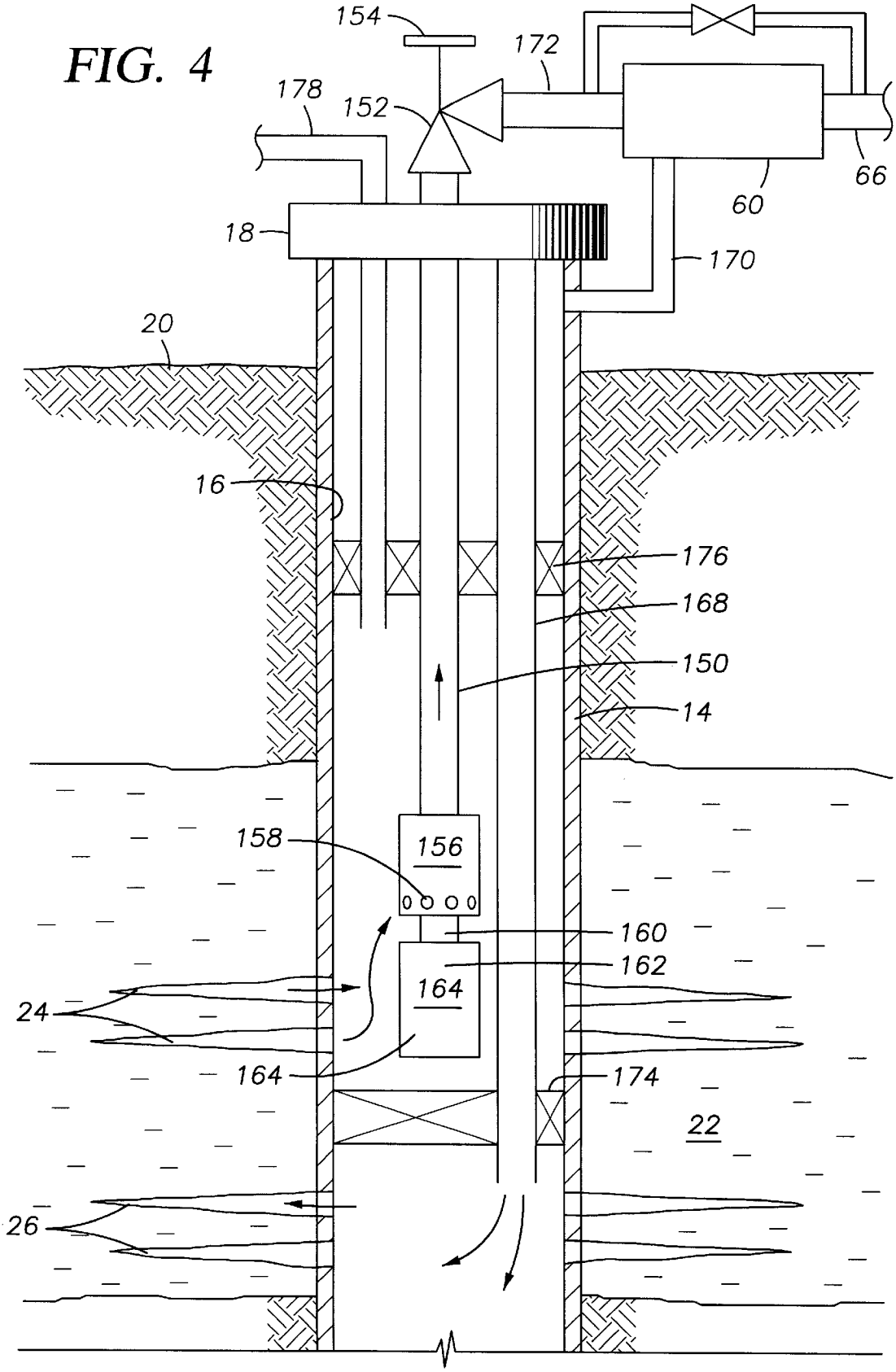
FIG. 4 is a cross-sectional schematic representation of a third exemplary separation system in accordance with the present invention having a surface-based separator assembly with means for injection of separated water back into the well.

FIG. 4 depicts a third exemplary embodiment for a separation and reinjection system constructed in accordance with the present invention. The well 10, in this instance, is a "downhole" well in that the injection perforations 26 are located downhole from the production perforations 24. Production tubing 150 is suspended within the annulus 16 from a wellhead 152 which includes an adjustable choke 154. The lower end of the production tubing 150 is affixed to a fluid pump 156 which includes lateral fluid intake ports 158 through which fluids within the annulus 16 may be drawn into the pump 156. A tubing section 160 interconnects the pump 156 with an elastomer seal 162 and motor 164 such that operation of the motor 164 will cause the pump 156 to draw fluids in the annulus 16 inward through ports 158 and pump those fluids upward through production tubing 150. Although not shown in FIG. 4, the production tubing 150 may incorporate additional fluid ports controlled by a sliding sleeve arrangement as described with respect to the arrangement shown in FIG. 1.

A reinjection string 168 is disposed within the annulus 16 in a side-by-side relation to the production tubing 150. A fluid flow line 170 interconnects the upper end of the reinjection string with the separator assembly 60 so that fluid exiting the separator assembly 60 is transmitted therethrough to the reinjection string 168. A second flow line 172 interconnects the wellhead 152 with the separator assembly 60 so that fluid from the production tubing 150 which is disposed through the wellhead 152 is transmitted therethrough to the separator assembly 60.

A packer 174 is set against the casing 14 below the production perforations 24 but above the injection perforations 26. Reinjection string 168 is disposed through the packer 174.

A triple penetration packer 176 is set within the annulus 16 at a point above the production perforations 24. Below the packer 176 the annulus 16 contains production gasses at formation pressure which enter the annulus 16 from the production perforations 24. Gas flow tubing 178 is disposed through the packer 176 and extends outward through the opening 18 of the well 10. Because the portion of the annulus 16 below the packer 176 will be at formation pressure, production gasses entering the annulus 16 from the production perforations 24 will tend to enter the gas flow tubing 178 for collection at the surface 20.

Operation of the assembly depicted in FIG. 4 is as follows during a late stage of production where it is desired to both pump production fluid toward the surface 20 and to separate the production fluid into separated oil and separated water. Operation of the motor 164 causes the pump 156 to draw production fluid from production perforations 24 into the pump 156 through fluid ports 158. The pump 156 then pumps the production fluid upward through the production tubing 150 and through wellhead 152 and flow line 172 into the separation assembly 60. The production fluid undergoes separation within the separation assembly 60 into separated oil and separated water. The separated oil is then directed through the collection pipe 66 for collection. The separated water is directed through flow line 170 to injection string 168 where it ultimately disposed under system pressure proximate injection perforations 26 for injection into the injection perforations.

Figure 5:
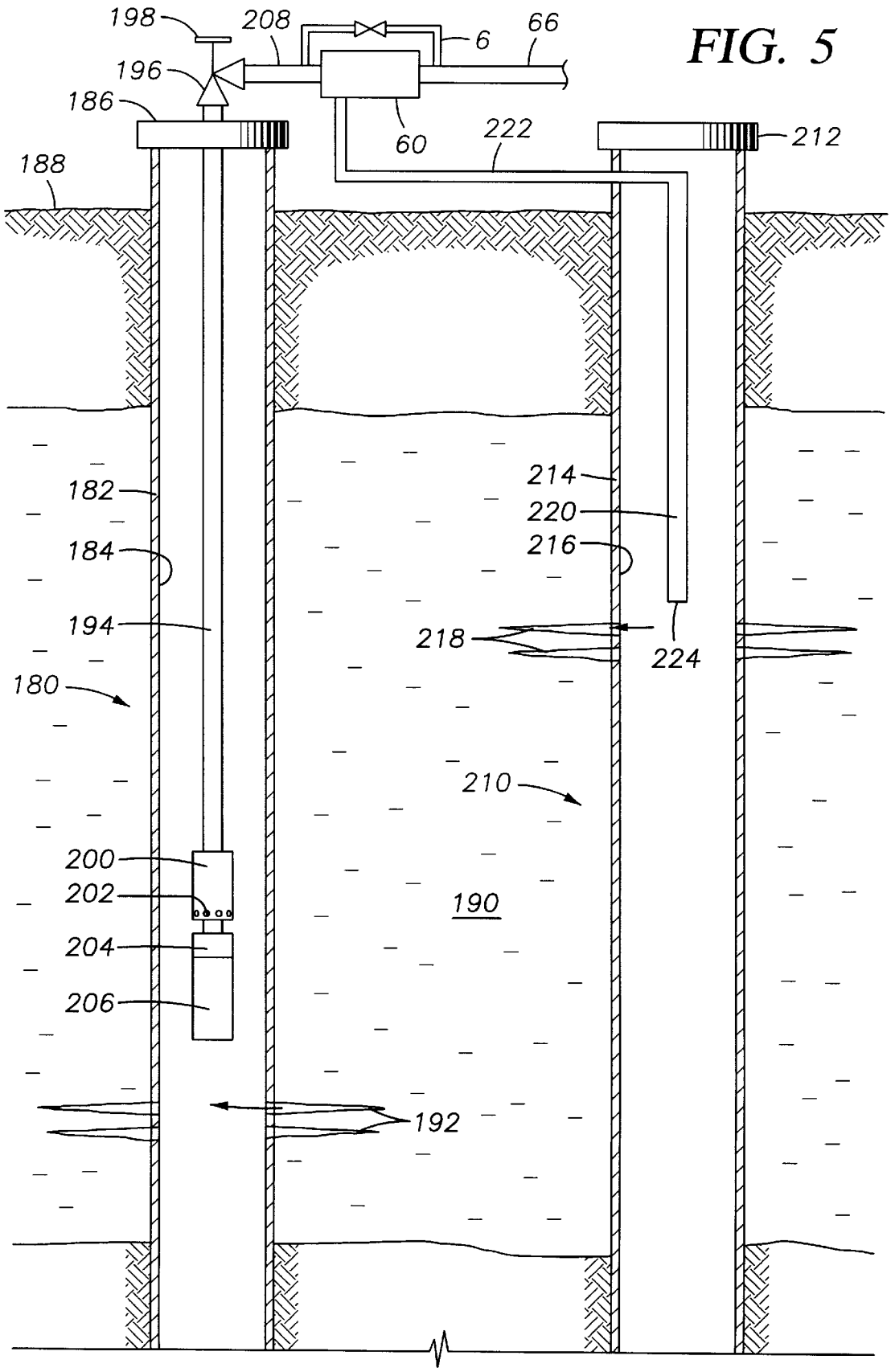
FIG. 5 is a cross-sectional schematic depiction of a fourth exemplary separation system in accordance with the present invention having a surface-based separator assembly with means for injection of separated water into a separate injection well.

An alternative embodiment is depicted in FIG. 5 in which the injection string is placed within a separate injection well into which it is desired to dispose separated water for injection into perforations in the injection well. Production well 180 is shown which includes a casing 182 defining an annulus 184. The casing 182 extends from an opening or entrance 186 at the surface 188 downward through a production zone 190. Production perforations 192 are disposed through the casing 182. Within the casing, production tubing 194 is suspended from a wellhead 196 having an adjustable choke 198. A fluid pump 200 is affixed at the lower end of the production tubing 194 having lateral fluid intake ports 202. An elastomer seal 204 and motor 206 are included to operate the pump 200.

A flow line 208 extends from the wellhead to the separator assembly 60, and collection flow pipe 66 extends from the separator assembly 60 to a collection device (not shown).

An injection well 210 is also disposed through the production zone 190 from an opening or entrance 212 proximate the surface 188. It is noted that the injection well 210 is physically separated from the production well 180 and that the amount of distance between the two wells is not significant in so far as the invention is concerned. The injection well 210 includes a casing 214 which defines an annulus 216. Injection perforations 218 are disposed through the casing 214 to permit fluid communication from the annulus 216 into the production zone 190.

Within the annulus 216 of the injection well 210, an injection string 220 is suspended. A fluid flow line 222 extends from the separator assembly 60 to the injection string 220. The lower end of the injection string 220 presents a fluid opening 224 which is located proximate the injection perforations 218.

Although the invention has been described in terms of preferred embodiments, those skilled in the art will recognize that numerous modifications and changes may be made while remaining within the scope and spirit of the invention.

While the foregoing is directed to the preferred embodiment of the present invention, other and further embodiments of the invention may be devised without departing from the basic scope thereof, and the scope thereof is determined by the claims which follow.

I claim:

1. A fluid separation and reinjection system for use in a wellbore extending through a liquid hydrocarbon producing zone producing an oil/water mixture and a water reinjection zone within the same wellbore, the system comprising:

(a) tubing disposed within the wellbore in fluid communication with the liquid hydrocarbon producing zone defining an oil flow channel and in fluid communication with the water reinjection zone in the same wellbore having the liquid hydrocarbon producing zone defining a water reinjection channel;

(b) a hydrocyclone separator separating the produced oil/water mixture into an oil rich phase and a water rich phase located at least partially above the wellbore and adjacent the wellbore, the separator having an inlet coupled to the oil flow channel and a water outlet coupled to the water reinjection channel and the separator positioned in proximity to a wellhead of the wellbore;

(c) a pump in fluid communication with the hydrocyclone separator pressuring the water for reinjection; and (d) a cylindrical sleeve disposed about the tubing, wherein the water reinjection channel is formed between the cylindrical sleeve and the tubing.

2. The system of claim 1, further comprising a packer for the tubing separating the channels to the producing zone and the water reinjection zone.

3. The system of claim 1, further comprising a first valve in fluid communication with the tubing directing the oil/water mixture to bypass the separator; and a second valve in fluid communication with the tubing directing the oil/water mixture into the separator.

4. The system of claim 1, wherein the water reinjection channel comprises a reinjection tubing string.

5. The system of claim 1, further comprising a bypass member coupled to the oil flow channel and adapted to bypass the separator.

6. The system of claim 1, further comprising a slidable sleeve valve comprising a valve and at least one port.

7. A fluid separation and reinjection system for use in a wellbore extending through a liquid hydrocarbon producing zone producing an oil/water mixture and a water reinjection zone within the same wellbore, the system comprising:

(a) tubing disposed within the wellbore in fluid communication with the liquid hydrocarbon producing zone defining an oil flow channel and in fluid communication with the water reinjection zone in the same wellbore having the liquid hydrocarbon producing zone defining a water reinjection channel;

(b) a hydrocyclone separator separating the produced oil/water mixture into an oil rich phase and a water rich phase located at least partially above the wellbore and adjacent the wellbore, the separator having an inlet coupled to the oil flow channel and a water outlet coupled to the water reinjection channel and the separator positioned in proximity to a wellhead of the wellbore;

(c) a pump in fluid communication with the hydrocyclone separator pressuring the water for reinjection;

(d) a first valve in fluid communication with the tubing directing the oil/water mixture to bypass the separator; and (e) a second valve in fluid communication with the tubing directing the oil/water mixture into the separator.

8. The system of claim 7, further comprising a slidable sleeve valve comprising a valve and at least one port.

9. A method of producing hydrocarbons from a wellbore in fluid communication with a producing zone and a reinjection zone of the same wellbore, comprising:

(a) producing a production stream of an oil/water mixture from a production tubing in the wellbore to a hydrocyclone separator located at least partially above the wellbore;

(b) separating the production stream into a water-rich stream and an oil-rich stream in proximity to a wellhead of the wellbore;

(c) pressurizing and reinjecting the water-rich stream into the same wellbore from which it was produced;

(d) maintaining separation of the water-rich stream from the production stream;

(e) disposing a cylindrical sleeve around the tubing in the wellbore, wherein the cylindrical sleeve has a terminal end positioned adjacent the reinjection zone; and (f) setting a second packer between the terminal end of the sleeve and the wellbore.

10. The method of claim 9, further comprising directing the oil-rich stream away from the wellbore.

11. The method of claim 9, further comprising setting a packer between the tubing and the wellbore at a position between the producing zone and the reinjection zone.

12. The method of claim 9, further comprising:

selectively bypassing the production stream around the separator.

13. The method of claim 12, wherein bypassing the production stream occurs at a predetermined percentage of water in the oil/water mixture.

14. The method of claim 9, further comprising disposing a reinjection tubing into the wellbore adjacent the production tubing wherein the water-rich stream is reinjected through the reinjection tubing.

15. The method of claim 9, further comprising:

disposing a tubing through the well into communication with a production zone;

disposing a reinjection tubing into the well and into communication with a reinjection zone that is downhole from the production zone; and setting a packer around the reinjection string at a location below the production zone and above the reinjection zone.

16. The method of claim 9, further comprising disposing a tubing through the wellbore into communication with a production zone, the tubing having a downhole pump developing sufficient pressure to produce the production stream, separate the production stream, and reinject the water-rich stream.

17. The method of claim 9, further comprising the steps of:

repeating steps (a) through (d) for a plurality of wellbores to produce a plurality of oil-rich streams; and collecting the plurality of oil rich streams.

18. The method of claim 17, further comprising removing water from the collected oil-rich streams.

19. A method of producing hydrocarbons from a wellbore in fluid communication with a producing zone and a reinjection zone of the same wellbore, comprising:

(a) producing a production stream of an oil/water mixture from a production tubing in the wellbore to a hydrocyclone separator located at least partially above the wellbore;

(b) separating the production stream into a water-rich stream and an oil-rich stream in proximity to a wellhead of the wellbore;

(c) pressurizing and reinjecting the water-rich stream into the same wellbore from which it was produced;

(d) maintaining separation of the water-rich stream from the production stream; and (e) bypassing the production stream around the separator.

20. A method of producing hydrocarbons from a wellbore in fluid communication with a producing zone and a reinjection zone of the same wellbore, comprising:

(a) producing a production stream of an oil/water mixture from a production tubing in the wellbore to a hydrocyclone separator located at least partially above the wellbore;

(b) separating the production stream into a water-rich stream and an oil-rich stream in proximity to a wellhead of the wellbore;

(c) pressurizing and reinjecting the water-rich stream into the same wellbore from which it was produced;

(d) maintaining separation of the water-rich stream from the production stream; and (e) selectively bypassing the production stream around the separator when the production stream contains less than about 70 percent water.

21. The method of claim 20, wherein bypassing the production stream occurs at a predetermined percentage of water in the oil/water mixture.

* * * * *